US005337671A

United States Patent [19]

Varmo

[11] Patent Number: 5,337,671

[45] Date of Patent: Aug. 16, 1994

[54] ARRANGEMENT IN A SMOKE SHELL

[75] Inventor: Kjell O. Varmo, Raufoss, Norway

[73] Assignee: Raufoss AS, Norway

[21] Appl. No.: 854,606

[22] PCT Filed: Jan. 16, 1992

[86] PCT No.: PCT/NO92/00006

§ 371 Date: Jun. 9, 1992

§ 102(e) Date: Jun. 9, 1992

[87] PCT Pub. No.: WO92/13251

PCT Pub. Date: Aug. 6, 1992

[30] Foreign Application Priority Data

Jan. 21, 1991 [NO] Norway ..... 910228

[51] Int. Cl.[5] ..... F42B 12/48

[52] U.S. Cl. ..... 102/334; 102/368

[58] Field of Search ..... 102/334, 367, 369, 282

[56] References Cited

U.S. PATENT DOCUMENTS

| | | | |
|---|---|---|---|
| 4,353,301 | 10/1982 | Jacobsen | 102/368 |
| 4,436,034 | 3/1984 | Jacobson et al. | 102/334 |
| 4,474,715 | 10/1984 | Weber et al. | 102/334 |
| 4,726,295 | 2/1988 | Embury et al. | 102/334 |

FOREIGN PATENT DOCUMENTS

| | | |
|---|---|---|
| 0293273 | 11/1988 | European Pat. Off. . |
| 3048595 | 7/1982 | Fed. Rep. of Germany . |
| 3035799 | 12/1987 | Fed. Rep. of Germany . |
| 142929 | 8/1980 | Norway . |
| 833740 | 10/1983 | Norway . |
| 881063 | 9/1988 | Norway . |

*Primary Examiner*—David H. Brown

*Attorney, Agent, or Firm*—Larson and Taylor

[57] ABSTRACT

The present invention relates to an arrangement in a smoke shell rendering protection in both the visible band, and/or the IR band and/or the millimeter band.

17 Claims, 1 Drawing Sheet

ARRANGEMENT IN A SMOKE SHELL

FIELD OF THE INVENTION

The present invention relates to an arrangement in a smoke shell which generates smoke in both the visible and/or IR range and/or millimeter range.

BACKGROUND OF THE INVENTION

Modern weapon systems utilize today the infrared (IR) part of the electromagnetic spectrum in addition to the visible spectrum. Especially the weapon systems which have been developed to defeat armoured fighting vehicles, comprise sighting devices operating in the infrared spectrum, which means that hostile objects can be observed and aimed at as well in daylight as in the dark.

Further, modern weapon systems utilize the millimeter band of the electromagnetic spectrum, for example in the range of 35–94 GHz, for observation, homing and destroying hostile objects.

PRIOR ART

What the prior art gives instructions for, for example as discussed in Norwegian patent application 83.3740, is that for dissemination of copper powder there must be used a separate bursting charge, i.e. a further bursting charge in addition to the charge which ignites the smoke elements.

Besides, the prior art according to Norwegian patent application 83.3740 gives instructions for smoke shells having an axial configuration, which includes a first chamber comprising smoke elements, and a second chamber comprising copper powder, said two chambers being arranged one after the other in the axial direction, and without the smoke elements and copper powder mutually influencing each other for coordinated dissemination of smoke in the visible band and the IR band or the millimeter band.

Also according to Norwegian patent application 88.1063 there is suggested on the one hand smoke generators generating visible smoke, and on the other hand a container including powder and having its own bursting charge or explosive rod. That the two types of smoke should operate separately from each other, is also obvious from this publication, since it is suggested that the two containers including smoke generating, pyrotechnical mixture are separated from the powder mixture by letting a device which initially connects the two different chambers, burst, for example by the breaking of a rod.

SUMMARY OF THE INVENTION

An object of the present invention is to provide a smoke system giving rapid protection over a large physical area, not only in the visible band, but also in the infrared and/or millimeter band of the electromagnetic spectrum.

According to the invention this is achieved in an arrangement in a smoke shell of the type as mentioned in the preamble, which is characterized in that the arrangement comprises a first inner container housing pyrotechnical instantaneous smoke elements associated with an ignition charge, as well as a second container arranged substantially radially in relation to the first container and being without an ignition charge, and housing means for smoke in the IR and/or millimeter band, such that the reaction of the pyrotechnical instantaneous smoke elements upon ignition of said smoke shell provides a large enough pressure for bursting also the outer container for thereby disseminating the instantaneous smoke elements over a smoke screening area together with the means for providing smoke screening in the IR band and/or millimeter band.

What is novel and characterizing in the present invention, thus appears in the replacement of the bursting charge for IR and millimeter smoke with the pyrotechnical charge itself which develops instantaneous smoke, and which contributes directly to the dissemination of IR and millimeter smoke, the pyrotechnical instantaneous smoke elements upon ignition of the smoke shell rendering sufficient pressure for disseminating themselves and thereby the enclosing powder of said types of smoke.

Further advantages and features of the present invention will appear from the following description and the appended patent claims.

BRIEF DISCLOSURE OF THE DRAWINGS

DESCRIPTION OF EMBODIMENTS

Figure 1:
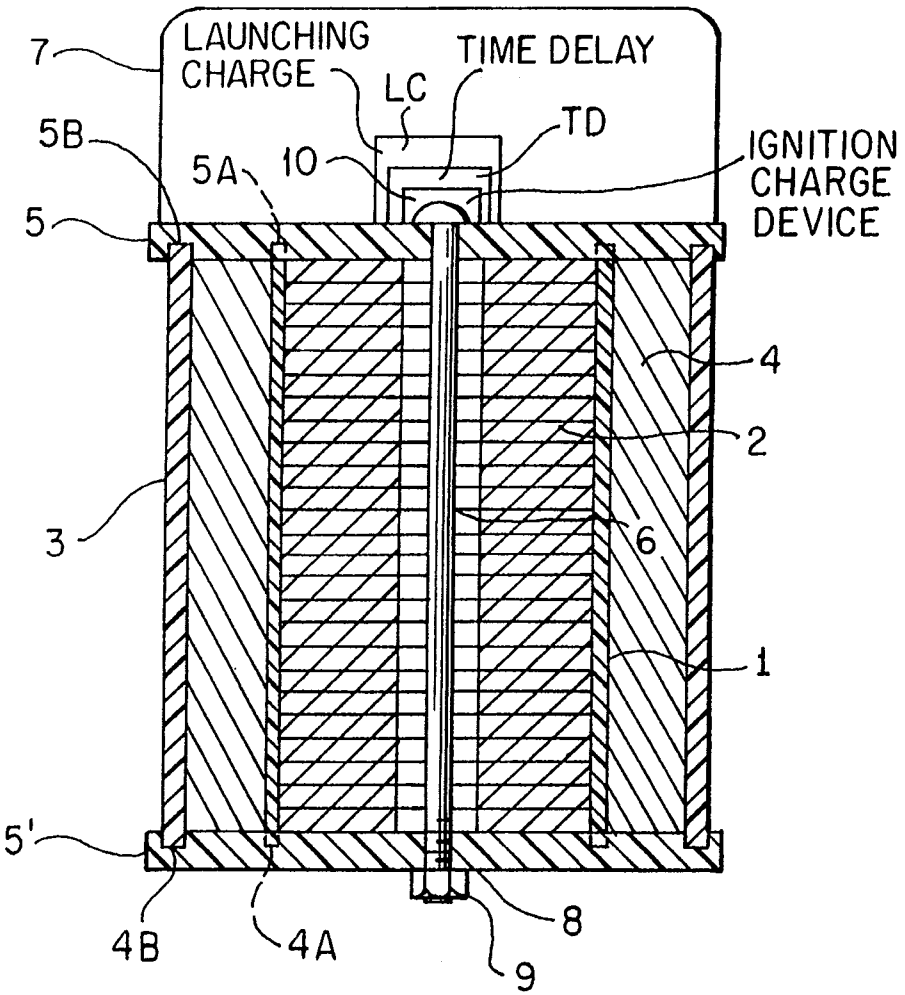
FIG. 1 is a side view partly in section of a first embodiment of an arrangement in a smoke shell according to the present invention.

In FIG. 1 which illustrates a side view partly in section of a first embodiment of an arrangement in a smoke shell according to the present invention, reference numeral 1 designates an inner pipe, and this inner pipe 1 is filled with substantially disc-shaped smoke elements 2. Outside the inner pipe 1 there is provided an outer pipe 3, and in the intermediate space between the inner pipe 1 and the outer pipe 3 there is provided powder or particles 4 providing screening in the IR band and/or powder or particles providing screening in the millimeter band.

The powder or particles obscuring in the IR band comprise either separately or in combination metal powder, for example aluminum, possibly flakes of bronze or brass, graphite powder or organic salts, or similar, this powder or these particles preferably being mixed with a flow-improving or anti-agglomerating material, for example sand particles in the size band of approx. 0.3 to 1.5 mm.

The powder or the particles obscuring in the millimeter wave band comprise preferably materials which scatter or absorb such millimeter waves, for example chaff material, cut to appropriate small dipole lengths, for example 4.1 mm at 35 GHz and 1.5 mm at 94 GHz. Also here this material is preferably mixed with a flow-improving or anti-agglomerating material, for example sand particles in the size band or range of 0.3–1.5 mm.

A ratio between the IR obscuring and/or millimeter obscuring material and the flow-improving or anti-agglomerating material can appropriately be between 1:2 and 1:16.

The inner pipe 1 and the outer pipe 3 are manufactured preferably from plastic, and in the embodiment illustrated in FIG. 1, the two pipes 1 and 3 are kept together with round end plates 5 and 5', namely by means of a central bolt 6 including a washer 8 and a nut 9. Preferably the end plates 5 and 5' can be provided with circular tracks 4A, 4B and 5A, 5B, respectively, into which the end portions of the pipes 1 and 2 fit. To one of the end plates, here the end plate 5, there is attached a contact head 7 including an electrical ignition device, or ignition charge device ID, a launching charge LC and a (pyrotechnical) time delay TD.

This embodiment of a smoke shell is ignited through the pyrotechnical delay TD and the ignition ID charge. The inner pipe 1 will then burst, and the effect of the burst will immediately result in the bursting of also the outer pipe 3, such that over a large physical area there are disseminated instantaneous smoke elements generating visual smoke, at the same time as there is taking place a dissemination of the powder or the material obscuring in the IR band and/or millimeter band. This is due to the the pressure inside the smoke shell, as the outer pipe 3 bursts, and the burning instantaneous smoke discs and the entrained material for obscuring the IR band and/or millimeter band are thus disseminated with large speed. It is to be understood that the object of the flow-improving or anti-agglomerating material, for example sand particles, is its functioning as a carrier material for the powder or the particles obscuring in the IR band and/or millimeter band.

Figure 2:
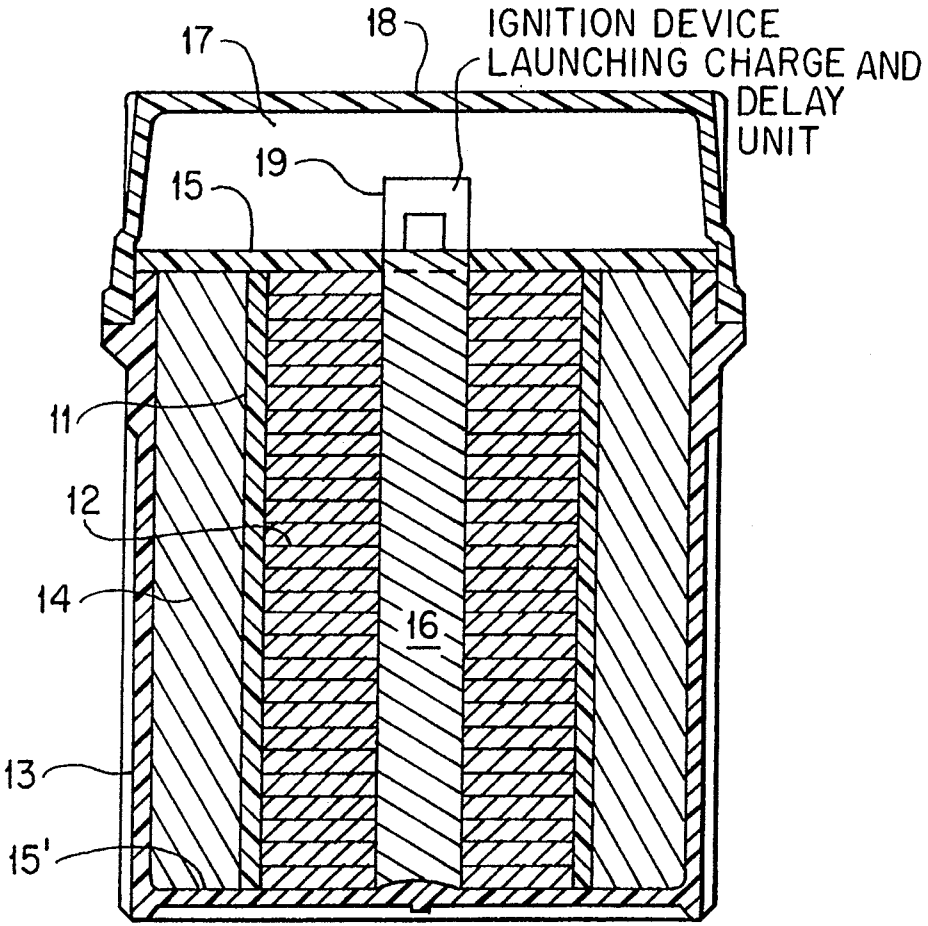
FIG. 2 is a section through an alternative embodiment of an arrangement in a smoke shell according to the present invention.

In FIG. 2 there is illustrated a section through an alternative embodiment of an arrangement in a smoke shell, comprising an inner wall 11 enclosing substantially disc-shaped smoke elements 12, as well as an outer wall 13 embracing the inner wall 11 with a certain play i.e., so that a space is defined therebetween, the intermediate space between the walls 11 and 12 being provided with a material 14 which upon dissemination obscurs in the IR band and/or millimeter band.

Also here there are provided end plates 15 and 15', respectively, holding the walls 11 and 13 together in an appropriate manner. Differently from the embodiment according to FIG. 1, there is here not used a central bolt for keeping the end plates 15 and 15' together, but instead there is provided a core of ignition charge 16. In the same manner as in the embodiment according to FIG. 1, there is in FIG. 2 attached to one of the end plates, here the end plates 15, a contact head 17 comprising an electrical ignition device, launching charge and delay unit 19, all of which is enclosed by a lid 18.

The mode of operation of this embodiment is analogue to the mode of operation of the embodiment according to FIG. 1.

I claim:

1. Arrangement in a smoke shell which generates smoke in both the visible and/or IR band and/or millimeter band, wherein the arrangement comprises a first inner container housing pyrotechnical instantaneous smoke elements associated with an ignition charge, as well as a second outer container arranged substantially radially in relation to the first container and being without an ignition charge, and housing means for providing screening in the IR and/or millimeter band, such that the reaction of the pyrotechnical instantaneous smoke elements upon ignition of the smoke shell provides a large enough pressure for also bursting the outer container for thereby disseminating the instantaneous smoke elements over a smoke screening area together with the means for providing screening in the IR and/or millimeter band.

2. The arrangement as claimed in claim 1, wherein the inner container comprises a pipe which is filled with said instantaneous smoke elements, and that the outer container comprises a pipe enclosing the inner pipe so that a space is defined therebetween, the space between the two pipes being filled with said means for providing screening in the IR band and/or millimeter band.

3. The arrangement as claimed in claim 1, wherein the first inner pipe includes a core of ignition charge and around and outside said core are disposed said smoke elements in the form of instantaneous smoke discs, and wherein outside the inner pipe there is provided said screening means in the form of a mixture of IR screening and/or millimeter screening material, including associated flow-improving or anti-agglomerating material, all of which are located in said outer container, said outer container comprising an outer pipe-shaped container with an integral bottom plate and releasable top plate over which top plate there is provided a lid.

4. The arrangement as claimed in claim 1, wherein the inner pipe and the outer pipe are made of plastic, and the pipes are kept together between round end plates by means of a central bolt.

5. The arrangement as claimed in claim 4, wherein a contact head unit including an electrical ignition device, launching charge and delay is attached to one of the end plates.

6. The arrangement as claimed in claim 1 wherein said smoke elements comprise substantially disc-shaped smoke elements (2;12), and said means for providing screening in the IR and/or millimeter band comprises powder or particles for providing screening in the IR band and/or powder or particles for providing screening in the millimeter band.

7. The arrangement as claimed in claim 6 wherein said powder or particles providing screening in the IR band comprise a graphite powder.

8. The arrangement as claimed in claim 6 wherein said powder or particles providing screening in the IR band comprise an organic salt.

9. The arrangement as claimed in claim 6, the powder or particles for providing screening in the IR band comprise metal elements mixed with a flow-improving or anti-agglomerating material.

10. The arrangement as claimed in claim 9, wherein the ratio of mixture between the IR screening and/or the millimeter screening material and the flow-improving and anti-agglomerating material is between 1:2 and 1:16.

11. The arrangement as claimed in claim 9 wherein said metal powder comprises aluminum powder.

12. Arrangement as claimed in claim 6 wherein said powder or particles for providing screening in the millimeter band comprise chaff material which is cut to dipole lengths and wherein said chaff material is mixed with a flow-improving or anti-agglomerating material.

13. The arrangement as claimed in claim 12 wherein said dipole lengths are 4.1 mm at 35 GHz and 1.5 at 94 GHz.

14. The arrangement as claimed in claim 12 wherein said flow-improving or anti-agglomerating material comprises sand particles in the size range of about 0.3 to 1.5 mm.

15. The arrangement as claimed in claim 6 wherein said powder or particles providing screening in the IR band comprise particles or powders selected from the group comprising metal powder, flakes of bronze or brass, graphite powder, organic salts or combinations thereof.

16. The arrangement as claimed in claim 15, wherein said powder or particles are mixed with a flow-improving or anti-agglomerating material.

17. The arrangement as claimed in claim 16 wherein said flow-improving material comprises sand particles having a diameter of about 0.3 to 1.5 mm.

* * * * *